US006491295B2

(12) United States Patent
Otsuka et al.

(10) Patent No.: US 6,491,295 B2
(45) Date of Patent: Dec. 10, 2002

(54) PAPER FEEDER

(75) Inventors: Kazuo Otsuka, Nagano (JP); Masafumi Furuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/867,707

(22) Filed: May 31, 2001

(65) Prior Publication Data

US 2002/0014735 A1 Feb. 7, 2002

(30) Foreign Application Priority Data

May 31, 2000 (JP) ..... 2000-161450

(51) Int. Cl.[7] ..... B65H 3/06; B65H 3/52

(52) U.S. Cl. ..... 271/118; 271/121; 271/126

(58) Field of Search ..... 271/118, 121, 271/126, 127

(56) References Cited

U.S. PATENT DOCUMENTS 5,582,399 A * 12/1996 Sugiura ..... 271/121
5,938,355 A * 8/1999 Suzuki ..... 271/121
6,126,161 A * 10/2000 Kato ..... 271/121
6,170,701 B1 * 1/2001 Youn ..... 271/121
6,315,282 B2 * 11/2001 Chua et al. ..... 271/121

* cited by examiner

*Primary Examiner*—H. Grant Skaggs
(74) *Attorney, Agent, or Firm*—Sughrue Mion, PLLC

(57) ABSTRACT

A paper feeding roller is provided in the vicinity of a first widthwise end of a transporting path extending to a recording apparatus. A hopper, for stacking a plurality of sheets of paper, includes an aligning face, on which leading ends of the stacked sheets are abutted to be aligned with each other. The aligning face is narrowed from a first side end thereof to a second side end thereof. Here, the first side end is in the vicinity of the first widthwise end of the transporting path, and the second side end is in the vicinity of a second widthwise end of the transporting path. The hopper includes a guide face provided on the first side end of the aligning face so as to extend parallel with the transporting path. The hopper includes a hopper member pivotably supported on the second side end of the aligning face in a cantilevered manner, so as to move on the aligning face such that distance change in accordance with the number of sheets stacked thereon in the first widthwise end side of the transporting path with respect to the paper feeding roller becomes larger than that in the second widthwise end side of the transporting path. A paper retainer is provided on a paper returner which is placed in the vicinity of an end portion of the hopper which faces the paper feeding roller. The paper retainer has a higher friction coefficient than the paper returner.

14 Claims, 18 Drawing Sheets

PAPER FEEDER

BACKGROUND OF THE INVENTION

This invention relates to a paper feeder used with a recording apparatus such as a printer for feeding sheet-like paper stacked on a hopper, and in particular to a paper feeder comprising a paper returner for returning an overlappedly transported sheet of paper to the hopper, the paper returner having a function of separating and feeding sheets of paper one by one.

A paper feeder used with a recording apparatus comprises two paper feeding rollers placed in a paper width direction, the one paper feeding roller being fixedly placed on one side edge side, and the other being built in an edge guide and semi-fixedly placed movably matching the paper width. A base end of the hopper is attached rotatably to a shaft at a right angle to the entry direction such that the whole of paper in the width direction is moved up or down at the same time by a cam mechanism associated with rotation of the paper feeding roller. A pivotable separation pad holder is provided with a separation pad to separate the sheets one by one from the hopper and feed each sheet.

When paper is abutted against the paper feeding roller, and at the same time, the separation pad is pressed against the paper feeding roller as the hopper moves up, the top sheet of paper is separated and fed. When the sheet arrives at a transport roller and skew removal is terminated, the paper feeding roller is rotated and stopped at a home position. Meanwhile, positioning is performed such that a distance between a leading edge of the paper sheet and a recording head is made constant is performed, and then print is started. When the paper feeding roller is stopped at the home position, a gap is formed between the paper feeding roller and the separation pad, but a part of the sheet being printed exists. At this time, another sheet overlappedly sent enters the gap, and two or more overlapped sheets may also be fed in conjunction with the sheet being printed in some cases. As a measure against such trouble, an idle roller is usually pressed against the separation pad. When a sheet being printed exists between the paper feeding roller and the separation pad, it is pressed against the separation pad by the idle roller, whereby entry of the sheets overlappedly sent is prevented. Each sheet whose entry is blocked is pushed and returned to the hopper by operating a paper return lever (paper returner) after the print terminates.

This related paper feeder comprises the paper feed rollers moved matching the paper width and thus has a large number of parts and also has a complicated structure. Since the paper returning operation is performed after print, the next paper feed operation cannot be started until the paper returning operation terminates, and thus the time interval between the print termination of one sheet and the print start of another sheet (throughput) is prolonged. Further, since the sheet being printed is pressed against the idle roller, a contact load with the sheet occurs and leads to a load of a motor drive system, etc.

SUMMARY OF THE INVENTION

It is therefore an object of the invention to provide a paper feeder with the reduced number of parts and a simplified structure for reducing costs and improved in straight-feeding property of paper from a hopper to a paper transporting passage.

It is another object of the invention to provide a paper feeder capable of performing the paper returning operation during printing.

In order to achieve the above objects, according to the present invention, there is provided a paper feeder, for feeding a sheet of paper to a transporting path extending to a recording apparatus, comprising:

- a paper feeding roller, provided in the vicinity of a first widthwise end of the transporting path;
- a hopper, for stacking a plurality of sheets of paper, including:
  - an aligning face, on which leading ends of the stacked sheets are abutted to be aligned with each other, the aligning face being narrowed from a first side end thereof to a second side end thereof, the first side end being in the vicinity of the first widthwise end of the transporting path, and the second side end being in the vicinity of a second widthwise end of the transporting path;
  - a guide face, provided on the first side end of the aligning face so as to extend parallel with the transporting path; and
  - a hopper member, pivotably supported on the second side end of the aligning face in a cantilevered manner, so as to move on the aligning face such that distance change in accordance with the number of sheets stacked thereon in the first widthwise end side of the transporting path with respect to the paper feeding roller becomes larger than that in the second widthwise end side of the transporting path;
- a paper returner, placed in the vicinity of an end portion of the hopper which faces the paper feeding roller, so as to be pivotable between a first position where the paper returner constitutes a part of the paper transporting passage, and a second position where the paper returner is isolated from the paper transporting passage; and
- a first paper retainer, provided on the first surface of the paper returner in the vicinity of the guide face of the hopper, wherein: the paper returner is placed at the first position so that a top sheet of paper in the hopper is abutted against the paper feeding roller, and is separated from other sheets of paper by the separation pad; and
- wherein the paper returner is placed at the second position so that a first face of the paper returner returns sheets of paper, which are entered in the paper transporting passage together with the sheet of paper to be fed, to the hopper.

In this configuration, since the hopper member is pivotably supported on the aligning face in the opposite side to a side the single paper feeding roller is provided, the number of parts can be reduced. Further, since a leading end of sheet overhanging from the aligning face to the paper feeding roller is prevented from advancing to the transporting path by the first paper retainer, the sheet enters the transporting passage straight and can be fed stably.

Preferably, the paper feeder further comprises a separation pad, provided on the first face of the paper returner, the separation pad having a friction coefficient which is higher than a friction coefficient of the first face of the paper returner.

In this configuration, the separation pad is attached to the paper returner, so that the number of parts can be decreased and the structure can be simplified for reducing costs as compared with the case where the separation pad holder and the paper return lever are provided separately as in the related paper feeder.

Preferably, the paper feeder further comprises an urging member, which urges the paper returner toward the second position. Here, the paper feeding roller includes a first portion which urges the first face of the paper returner toward the first position, against an urging force of the urging member.

In this configuration, the first face of the paper returner is always abutted against the paper feeding roller, and paper pressing and paper returning operations of the paper returner are made reliable.

Preferably, the first paper retainer is a sheet member having a higher friction coefficient than the first face of the paper returner.

In this configuration, the leading end of sheet does not slip and the orderly stacking is held reliably.

Preferably, the paper feeder further comprises a second paper retainer, provided in the vicinity of the pivotal center of the hopper member, the second retainer having a support face for supporting a part of sheets stacked on the hopper member.

In this configuration, since the leading end of sheet overhanging from the aligning face to the paper feeding roller is also supported in the vicinity of the pivotal center of the hopper member by the second paper retainer, the sheet is more reliably prevented from advancing to the transporting path.

Here, it is preferable that the support face of the second paper retainer is narrowed from a side closer to the pivotal center of the hopper member to a side closer to the paper feeding roller.

In this configuration, since restraining force of the paper feeding roller becomes large from the pivotal center to the free end of the hopper member, when the paper feeding is performed, particularly, firm paper such as an OHP sheet is easily caught in the second paper retainer. However, the support face is narrowed on the paper feeding roller side, whereby if paper is restrained by the paper feeding roller at a local point, it smoothly climbs over the second paper retainer and is fed reliably.

Also, it is preferable that the support face of the second paper retainer is placed such that a leading end of the sheet in the vicinity of the pivotal center of the hopper member is abutted thereon when the paper retainer is placed at the first position.

In this configuration, since the leading end of sheet on the pivotal center of the hopper member side is supported by the second paper retainer at the same time that the restraining force on the paper feeding roller side is increased as the paper returner is placed in the first position, so that paper enters the paper transporting passage straight without skew.

According to the present invention, there is also provided a paper feeder, for feeding a sheet of paper to a transporting path extending to a recording apparatus, comprising:

a paper feeding roller, provided in the vicinity of a first widthwise end of the transporting path;

a hopper, for stacking a plurality of sheets of paper, including:

an aligning face, on which leading ends of the stacked sheets are abutted to be aligned with each other, the aligning face being narrowed from a first side end thereof to a second side end thereof, the first side end being in the vicinity of the first widthwise end of the transporting path, and the second side end being in the vicinity of a second widthwise end of the transporting path;

a guide face, provided on the first side end of the aligning face so as to extend parallel with the transporting path; and a hopper member, pivotably supported on the second side end of the aligning face in a cantilevered manner, so as to move on the aligning face such that distance change in accordance with the number of sheets stacked thereon in the first widthwise end side of the transporting path with respect to the paper feeding roller becomes larger than that in the second widthwise end side of the transporting path;

a paper returner, placed in the vicinity of an end portion of the hopper which faces the paper feeding roller, so as to be pivotable between a first position where the paper returner constitutes a part of the paper transporting passage, and a second position where the paper returner is isolated from the paper transporting passage; and a first paper retainer, provided in the vicinity of the pivotal center of the hopper member, the second retainer having a support face for supporting a part of sheets stacked on the hopper member.

wherein the paper returner is placed at the first position so that a top sheet of paper in the hopper is abutted against the paper feeding roller, and is separated from other sheets of paper by the separation pad; and wherein the paper returner is placed at the second position so that a first face of the paper returner returns sheets of paper, which are entered in the paper transporting passage together with the sheet of paper to be fed, to the hopper.

Preferably, the paper feeder further comprises a separation pad, provided on the first face of the paper returner, the separation pad having a friction coefficient which is higher than a friction coefficient of the first face of the paper returner.

Preferably, the paper feeder further comprises an urging member, which urges the paper returner toward the second position. Here, the paper feeding roller includes a first portion which urges the first face of the paper returner toward the first position, against an urging force of the urging member.

Preferably, the support face of the first paper retainer is narrowed from a side closer to the pivotal center of the hopper member to a side closer to the paper feeding roller.

Preferably, the support face of the first paper retainer is placed such that a leading end of the sheet in the vicinity of the pivotal center of the hopper member is abutted thereon when the paper retainer is placed at the first position.

Preferably, the paper feeder further comprises a second paper retainer, provided on the first surface of the paper returner in the vicinity of the guide face of the hopper.

Here, it is preferable that the second paper retainer is a sheet member having a higher friction coefficient than the first face of the paper returner.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
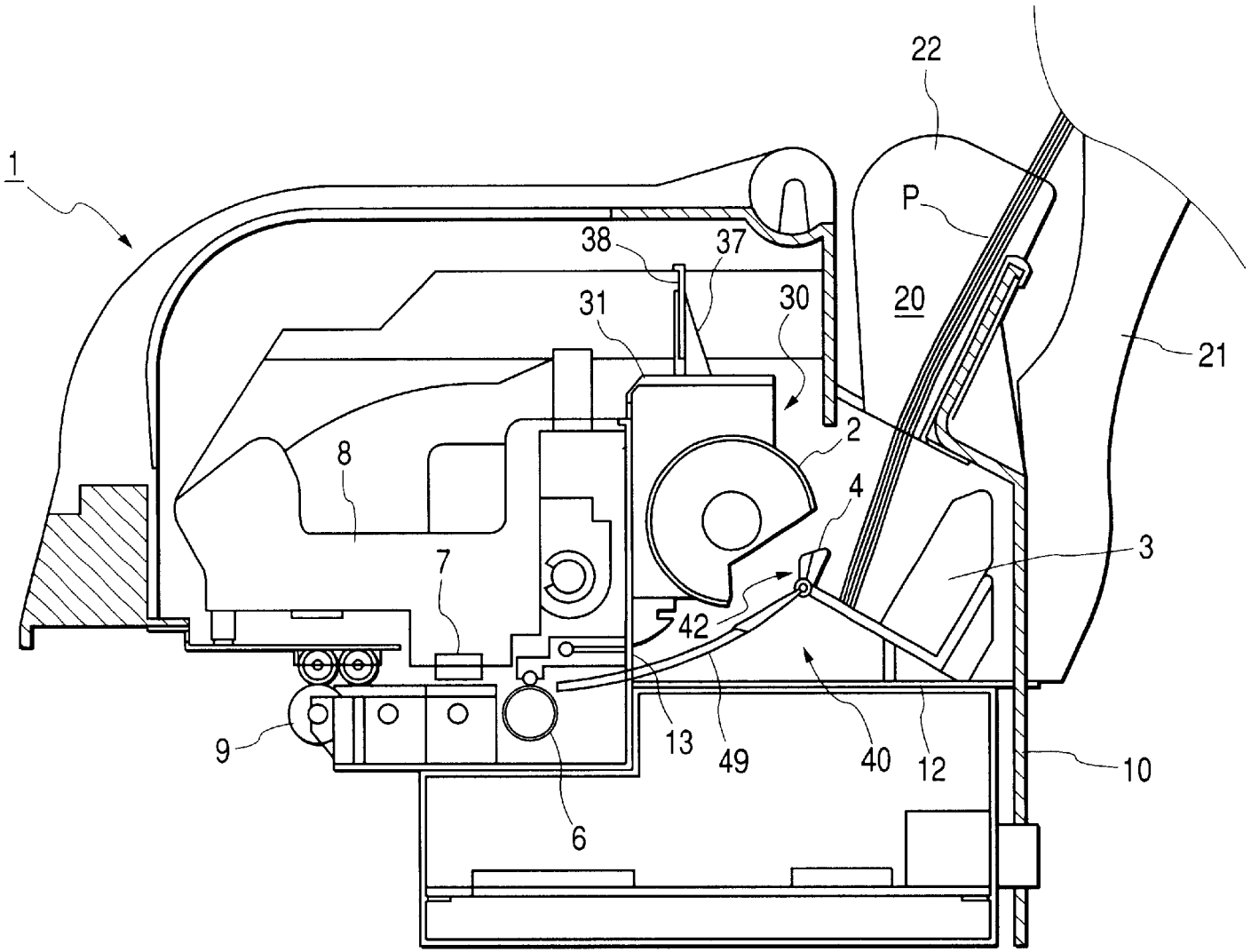
FIG. 1 is a transverse sectional view of a recording apparatus incorporating a paper feeder according to the invention.

Referring now to the accompanying drawings, there are shown preferred embodiments of the invention. FIG. 1 is a transverse sectional view of a recording apparatus incorporating a paper feeder according to the invention.

In a recording apparatus 1, a separation pad 4 is abutted against a rotating paper feeding roller 2 to separate one sheet of paper from a plurality of sheets of paper; P stacked on a hopper 3. The separated sheet is fed to a transport roller 6 along a paper guide 49, and a skew is removed, then the sheet is sent to a record area matching the print timing. Printing is performed by reciprocating :a recording head 7 mounted on a carriage 8 in a subscanning direction of the sheet. Then the sheet is discharged by a discharge roller 9.

A paper support 21 is attached to a housing 10 of the recording apparatus 1 and an edge guide 22 for regulating the side margin of the paper P supported on the paper support 21 is slidably placed in the housing 10. The hopper 3 is rotatably placed between the edge guide 22 and the paper feeding roller 2, and when the hopper 3 is moved up, the separation pad 4 presses the top sheet of paper against the paper feeding roller 2 and separates and feeds the sheet.

A paper feeder 20 includes a first unit 30 comprising the paper feeding roller 2, an auxiliary roller 33, a transmission gear 35, etc., built in one piece, and a second unit 40 comprising the hopper 3 and a paper returner 42 having the separation pad 4, built in a frame 41 in one piece. The first unit 30 is fixed to the rear of a frame 13 partitioning the carriage 8, and the second unit 40 is attached to a main frame 12 so that the bottom portion of the frame 41 shaped like a mountain in cross section is roughly on an extension of a paper, transporting passage connecting the transport roller 6 and the discharge roller 9. The units make it possible to reduce the number of assembling steps into the recording apparatus and lessen adjustment of the post-assembled units.

The first and second units will be discussed in more detail.

Figure 2:
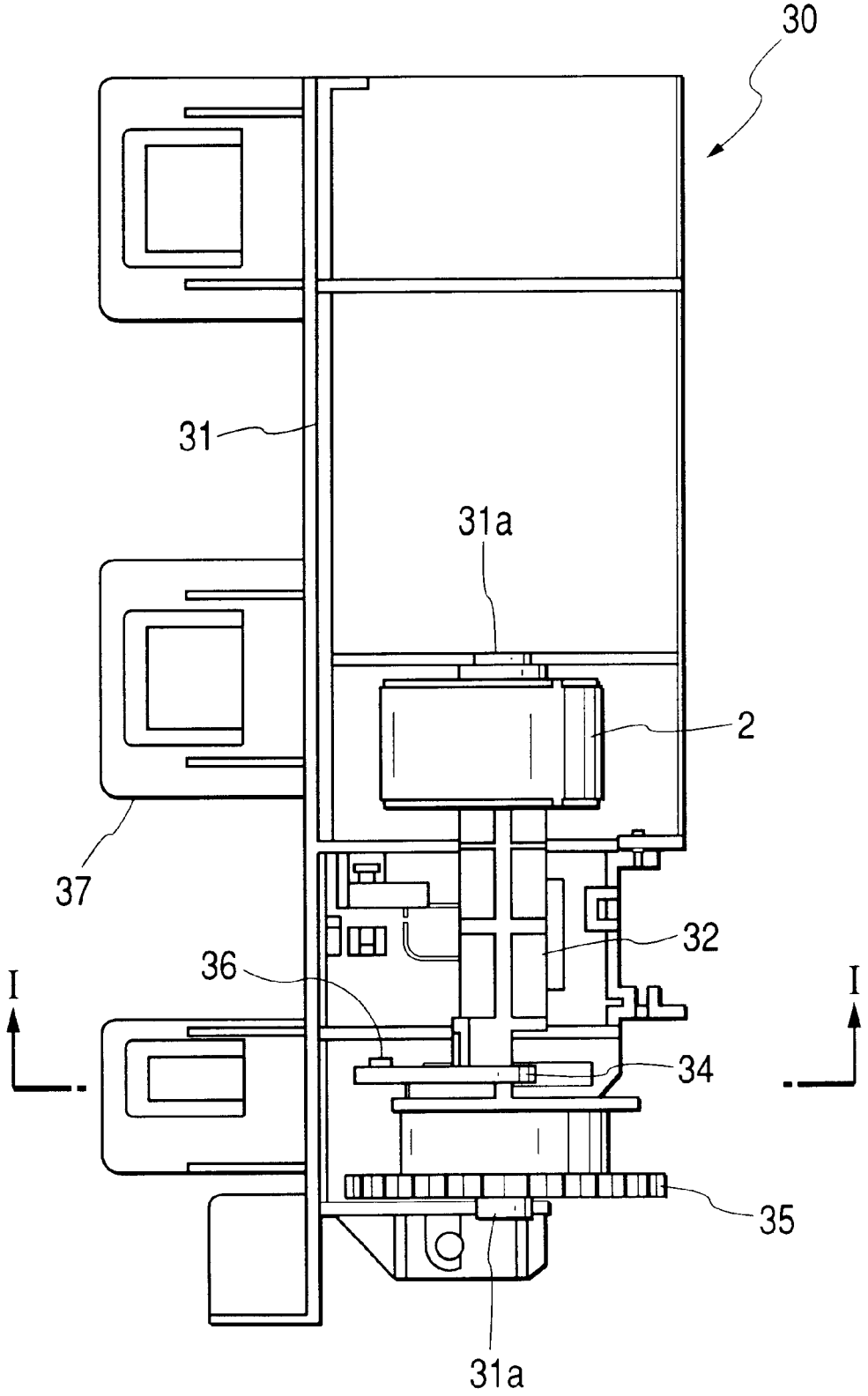
FIG. 2 is a plan view of a first unit.

In FIG. 2, the first unit 30 comprises a roller shaft 32 supported on a bearing part 31*a* of a roller holder 30 for rotation, and the paper feeding roller 2 and the auxiliary roller 33 are placed on the roller shaft 32. A hopper driving cam 34 forming a cam mechanism for moving up or down the hopper 3, and the transmission gear 35 are placed on the roller shaft 32. A subsidiary cam 36 for performing the initial inclining operation of the paper returner described later is placed on a side of the hopper driving cam 34. The transmission gear 35 is associated with a drive gear of a paper feed motor (not shown) via an intermediate transmission gear.

Figure 3:
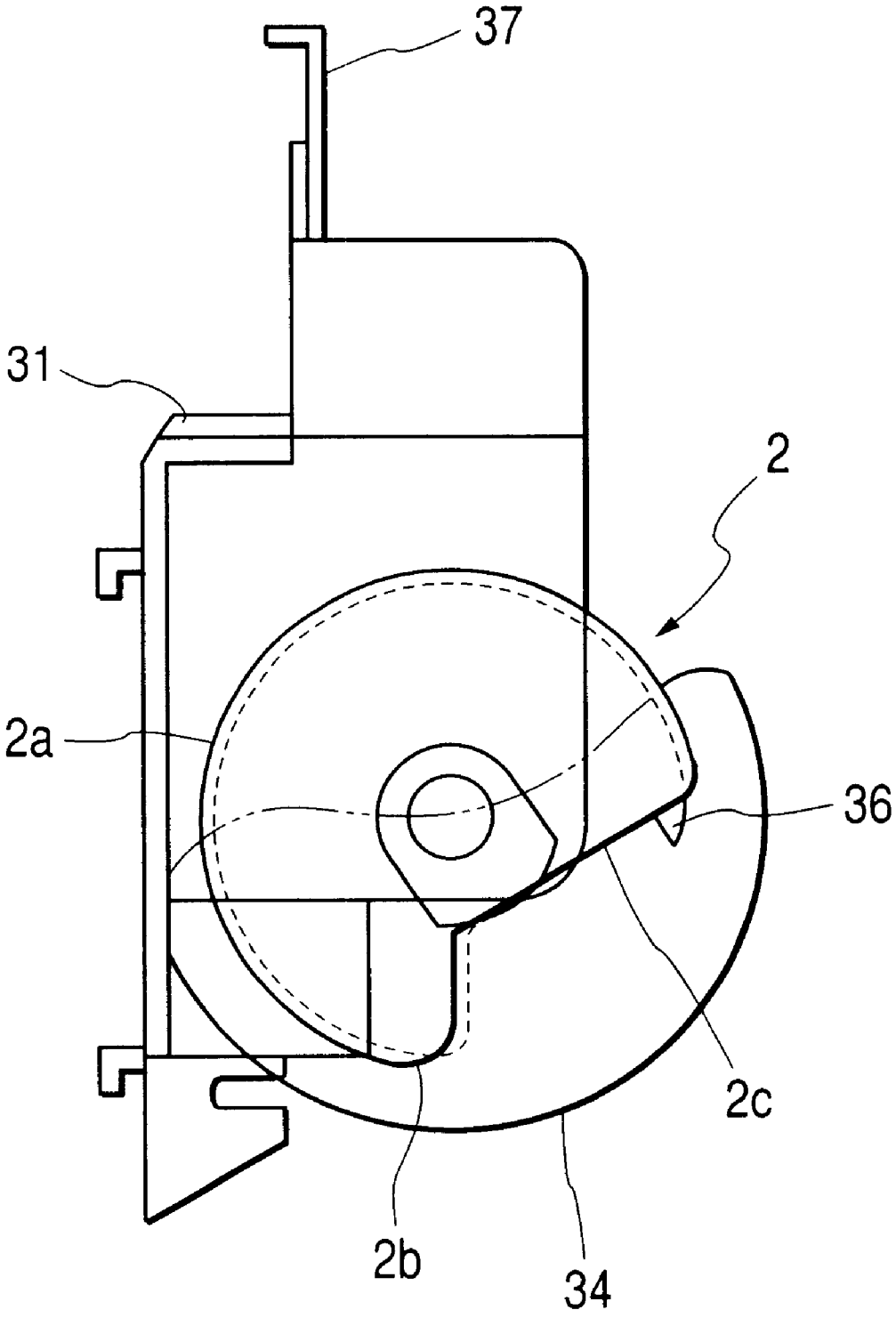
FIG. 3 is a side view of I—I arrow view in FIG. 2.

The paper feeding roller 2 consists of a round portion 2*a* and a flat portion 2*c*, as shown in FIG. 3, and a friction member is attached to the round portion 2*a* for feeding paper. The round portion 2*a* is extended to a protruded portion 2*b* for enlarging the circumferential for the paper feeding. The protruded portion 2*b* acts so as to reliably feed paper to the transport roller 6, if the paper load capacity of the hopper 3 changes. If one sheet of paper exists in the hopper 3, the time required to move up the hopper 3 from the lowermost position to abut the sheet of paper against the paper feeding roller 2 becomes the longest. That is, the paper feeding roller 2 rotates at a predetermined angle until the sheet of paper is abutted against the paper feeding roller 2, and thus the length of the protruded portion 2*b* is set so that paper arrives at the transport roller 6 as it is fed from the abutment position. Since the protruded portion 2*b* is provided, the circumferential length used for the paper feeding is extended without enlarging the diameter of the paper feeding roller 2, thereby the apparatus can be miniaturized. Numeral 37 denotes a flat cable retainer placed in the frame 31 to retain a flat cable 38 for transmitting a print signal to the recording head 7 (see FIG. 1).

Figure 4:
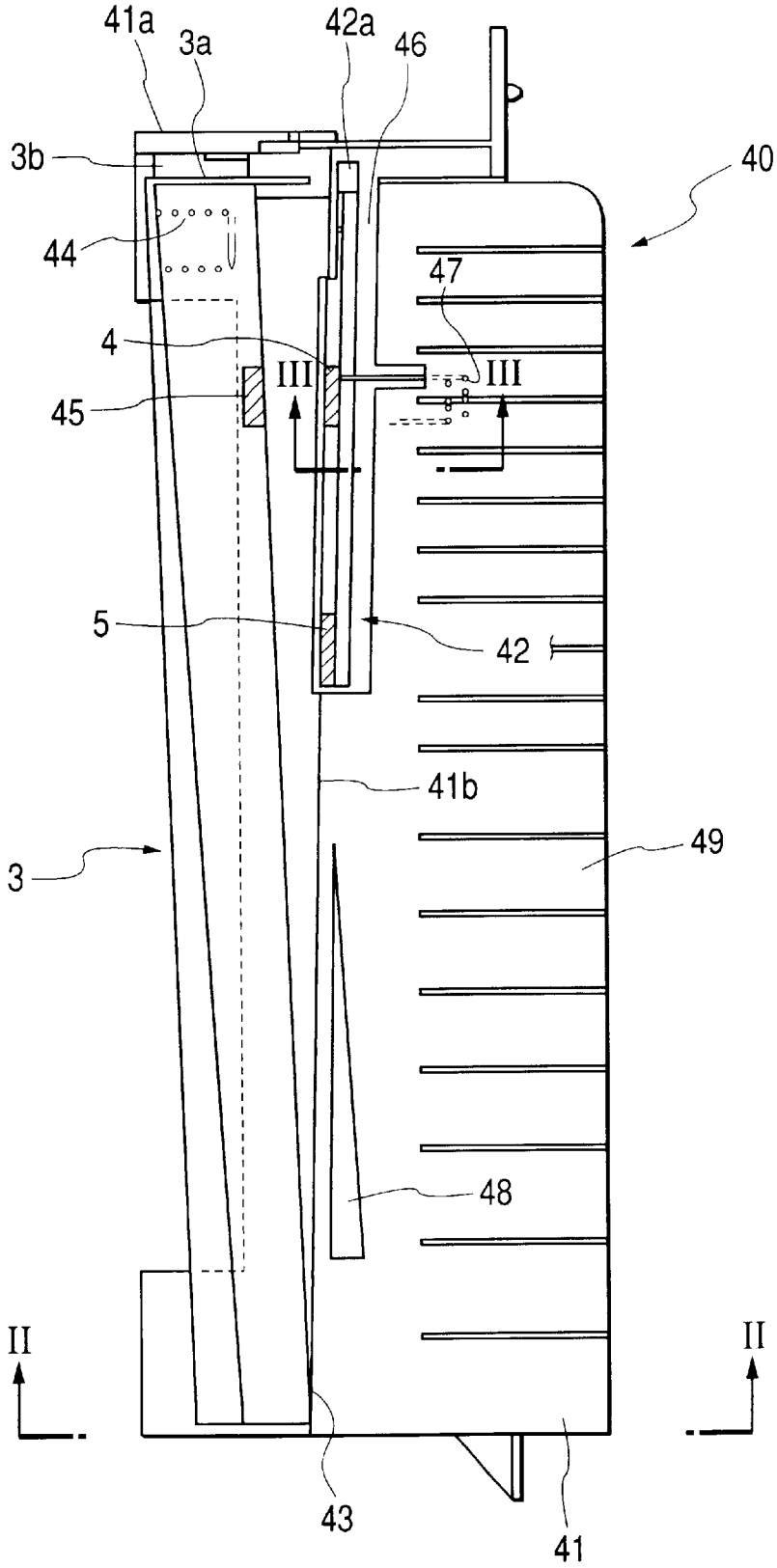
FIG. 4 is a plan view of a second unit.
Figure 5:
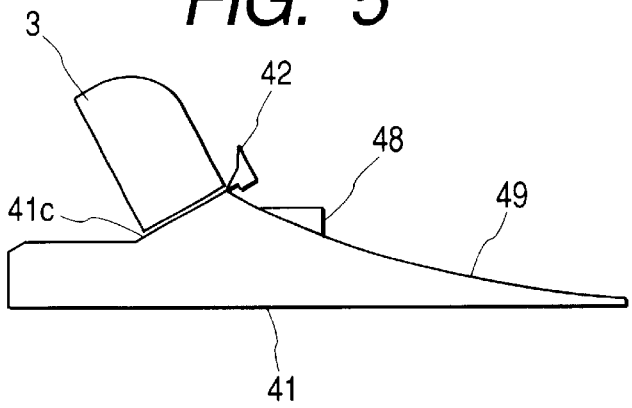
FIG. 5 is a side view of II—II arrow view in FIG. 4.

In the second unit 40, as shown in FIGS. 4 and 5, a front inclined face of the frame 41, which is shaped like a mountain in cross section extending in the width direction of the recorder 1, is used as the paper guide 49, and a rear inclined face of the frame 41 is used as an aligner 41*c* on which leading edges of sheets are abutted to be aligned and the hopper 3 is placed. On the top of the frame 41, the paper returner 42 is placed along a ridgeline portion 41*b* (boundary between the aligner 41*c* and the paper guide 49), and a base end of the paper returner 42 is placed in the ridgeline portion 41*b* for rotation. The hopper 3 is pivotably attached with one end in the width direction of the recorder 1 as a support point 43 along the rear inclined face of the frame 41 and an opposite end is positioned on the side of the first unit 30 and a hopper edge guide 3*a* is provided. The upper end face thereof forms a hopper cam follower 3*c* on which the hopper driving cam 34 acts. A projection 3*b* extending from the hopper edge guide 3*a* to the outside is formed and is inserted into a hopper guide 41*a* placed upright from the frame 41 for regulating motion of the opposite end of the hopper 3 so that it is moved only up or down.

The rotation support point 43 of the hopper 3 is placed so that the hopper face in the proximity of the rotation support point 43 almost matches the ridgeline portion 41*b*, for preventing the paper tip from being caught in the frame 41 on the rotation support point 43 side of the hopper 3, when paper is set. A hopper spring 44 is placed between the hopper 3 and the frame 41 on the rear in the proximity of the opposite end of the hopper 3 for urging the hopper 3 in the crest direction of the inclined face. A sheet 45 having a friction coefficient higher than that of other hopper face is put on the hopper 3 so as to match with the position of the separation pad 4.

Figure 7:
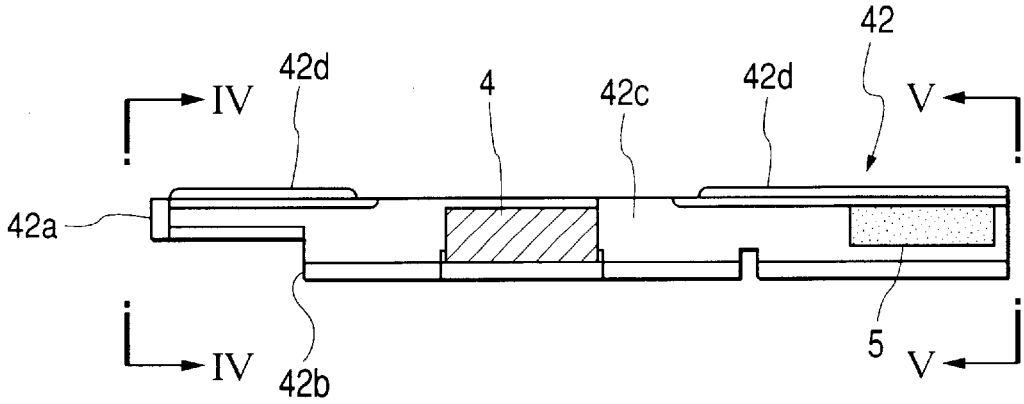
FIG. 7 is a plan view of the paper returner.
Figure 8:
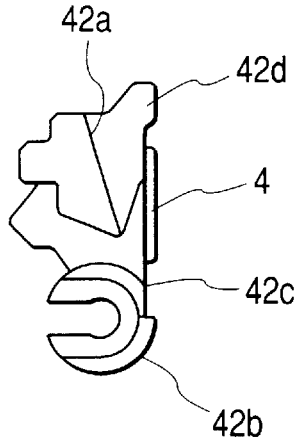
FIG. 8 is a side view of IV—IV arrow view in FIG. 7.
Figure 9:
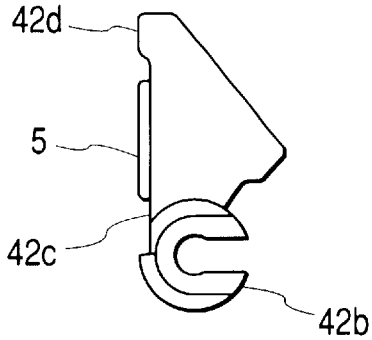
FIG. 9 is a side view of V—V arrow view in FIG. 7.
Figure 10:
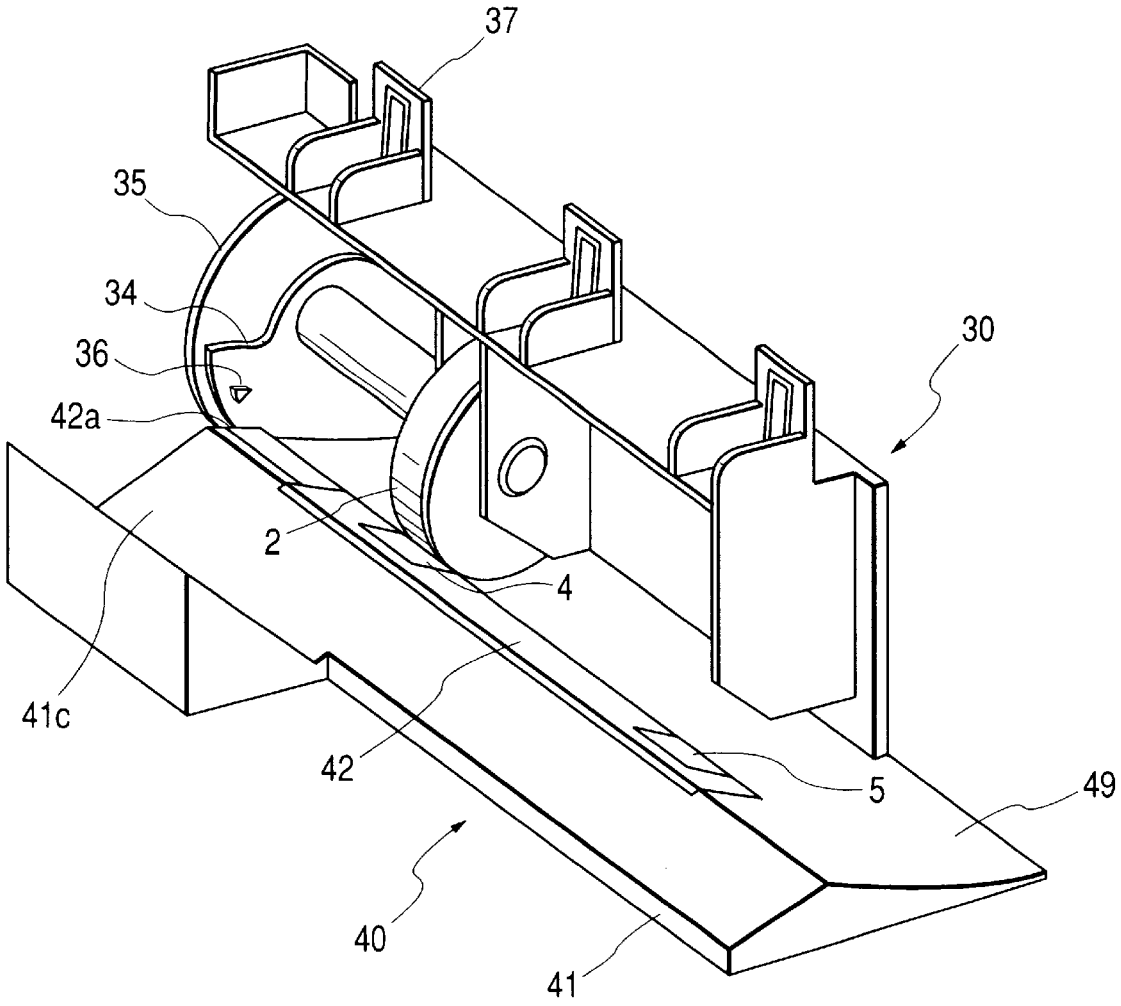
FIG. 10 is a perspective view when the first and second units are assembled.

As shown in FIGS. 7 to 9, a base end 42*b* formed as a bearing structure is inserted into a shaft part of the frame 41, whereby the paper returner 42 is attached for rotation. The separation pad 4 and a shift stopper 5 which are placed away from each other are provided on a surface 42*c* of the paper returner 42. The separation pad 4 is made of a material having a higher friction coefficient than the surface 22*c*. The shift stopper 5 is a sheet-like member having a higher friction coefficient than the surface 22*c*, such as cork, etc.

A cam follower 42*a* for initially inclining the paper returner 42 is placed on the edge guide 3*a* side of the hopper 3 and the subsidiary cam 36 placed on the side of the hopper driving cam 34 acts on the cam follower 42*a*. The subsidiary cam 36 and the cam follower 42*a* constitute an initial incliner which starts to rotate the paper returner 42 at a predetermined angle from the stand-up position to the fall-down position in association with rotation of the paper feeding roller 2 in a paper feed direction.

At a free end on an opposite side to the base end 42*b*, a protrusion 42*d* is formed on the surface 42*c* in a portion except the separation pad 4 is provided. The protrusion 24*d* acts so as to reliably grasp the leading end of sheet, and return it to the hopper 3 when the paper returning operation is performed as described later.

Figure 6A:
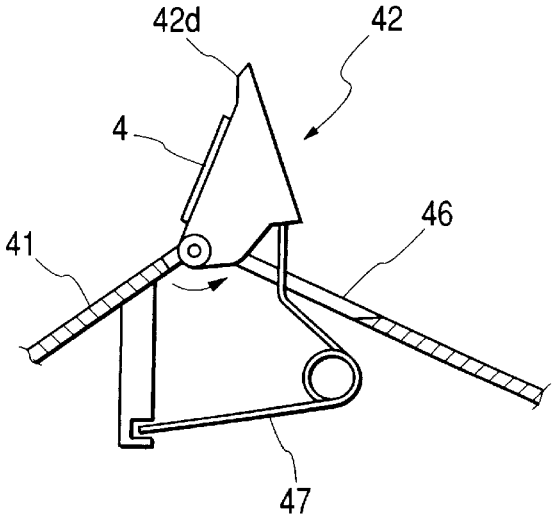
FIGS. 6A and 6B are schematic representations to show operation of a paper returner in sectional view taken on line III—III in FIG. 4.
Figure 6B:
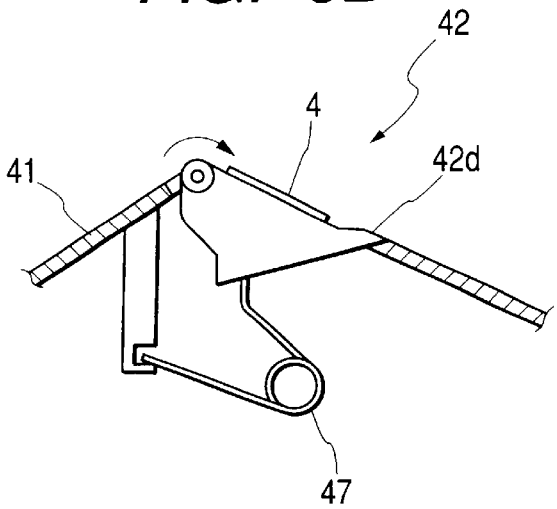

The paper guide 49 is formed with a notch part 46 of roughly the same shape as the paper returner 42. The notch part 46 is covered when the paper returner 42 rotates against the urging force of a paper returner spring 47 from the stand-up position shown in FIG. 6A to the fall-down position shown in FIG. 6B. The notch part 46 is flush with the paper guide 49. The paper returner spring 47 is implanted as a coil spring, for example, and is disposed on the rear slope of the frame 41. The paper returner spring 47 is retained at one end on the back of the paper returner 42 and at an opposite end on the frame 41 for urging the paper returner 42 so as to stand up the paper returner 42 as shown in FIG. 6A.

The paper returner 42 stands up almost vertically for blocking accidental entry of paper into the paper transporting passage when paper is set. In the stand-up state, the paper returner 42 is out of the rotation path of a roller face of the paper feeding roller 2 and a rotation force cannot be given. Then, to enter a portion for making the rotation force act on the paper returner 42 in the rotation path of the roller face of the paper feeding roller 2, the paper returner 42 is initially rotated at a predetermined angle in association with rotation of the paper feeding roller 2 by the subsidiary cam 36 and the cam follower 42*a* (the initial incliner) at the initial stage of rotation of the paper feeding roller 2 for feeding paper. Then, the force from the paper feeding roller 2 acts directly on the paper returner 42 for rotating the same. Accordingly, the paper returner 42 can be rotated smoothly.

On side of the hopper 3 close to the rotation support point 43, a paper receptor 48 is formed on the paper guide 49 near to the ridgeline portion 41*b* and has a triangular plane which is wide on the rotation support point 43 side of the hopper 3 and becomes narrower toward the center, whereby a load shift of stacked sheets of paper is prevented.

Figure 11A:
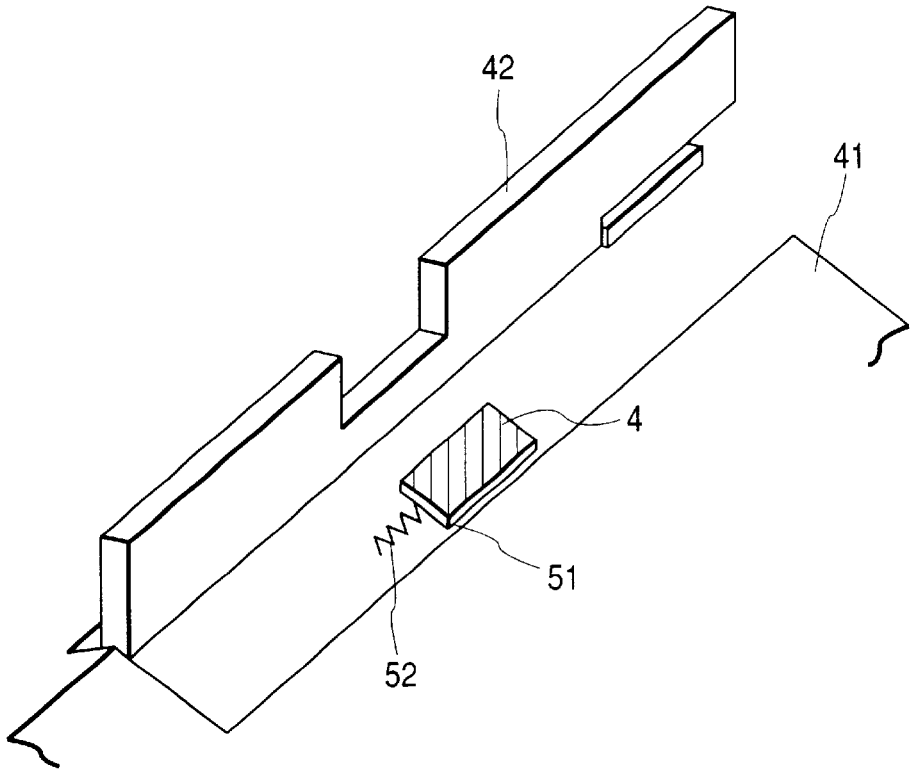
FIG. 11A is a perspective view to show a stand-up state of a paper returner according to another embodiment of the invention.
Figure 11B:
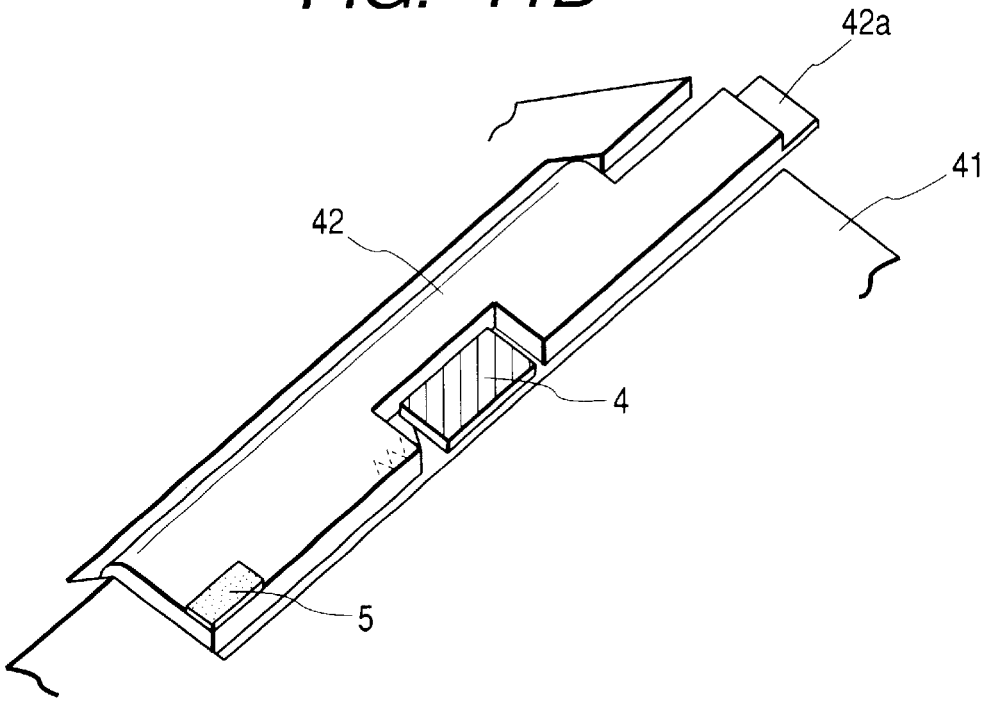
FIG. 11 B is a perspective view to show a fall-down state of the paper returner of FIG. 11 A.

Another embodiment of the invention wherein a separation pad and a paper returner are formed separately will described below. FIG. 11A is a perspective view to show a stand-up state of the paper returner and FIG. 11B is a perspective view to show a falldown state of the paper returner. A separation pad 4 is attached at one end to a separation pad holder 51 rotatably supported on a main frame 12. The separation pad holder 51 is urged to the side of a paper feeding roller 2 by a spring 52. A paper returner 42 has a portion opposed to the separation pad 4 as a notch, and a first paper retainer 5 is put at a position away from the separation pad 4 to the side of a support point 43 of a hopper 3.

Figure 12:
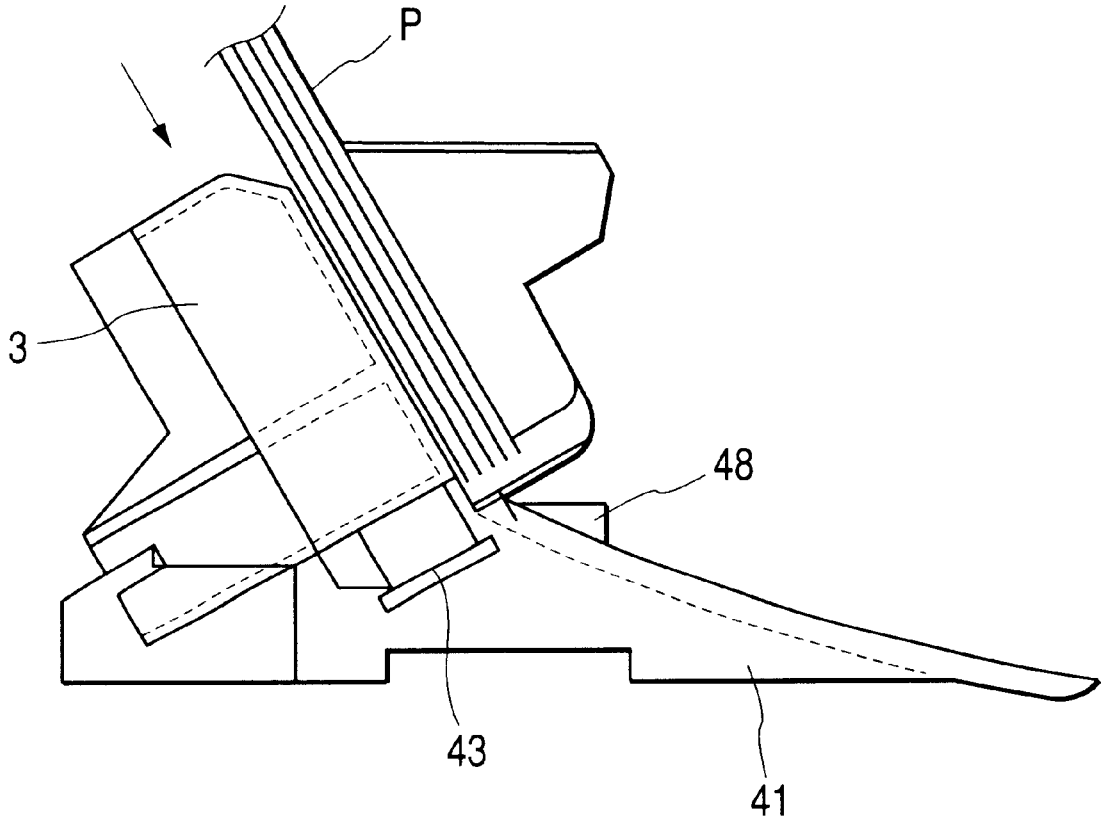
FIG. 12 is a side view of a hopper when paper is set.
Figure 13:
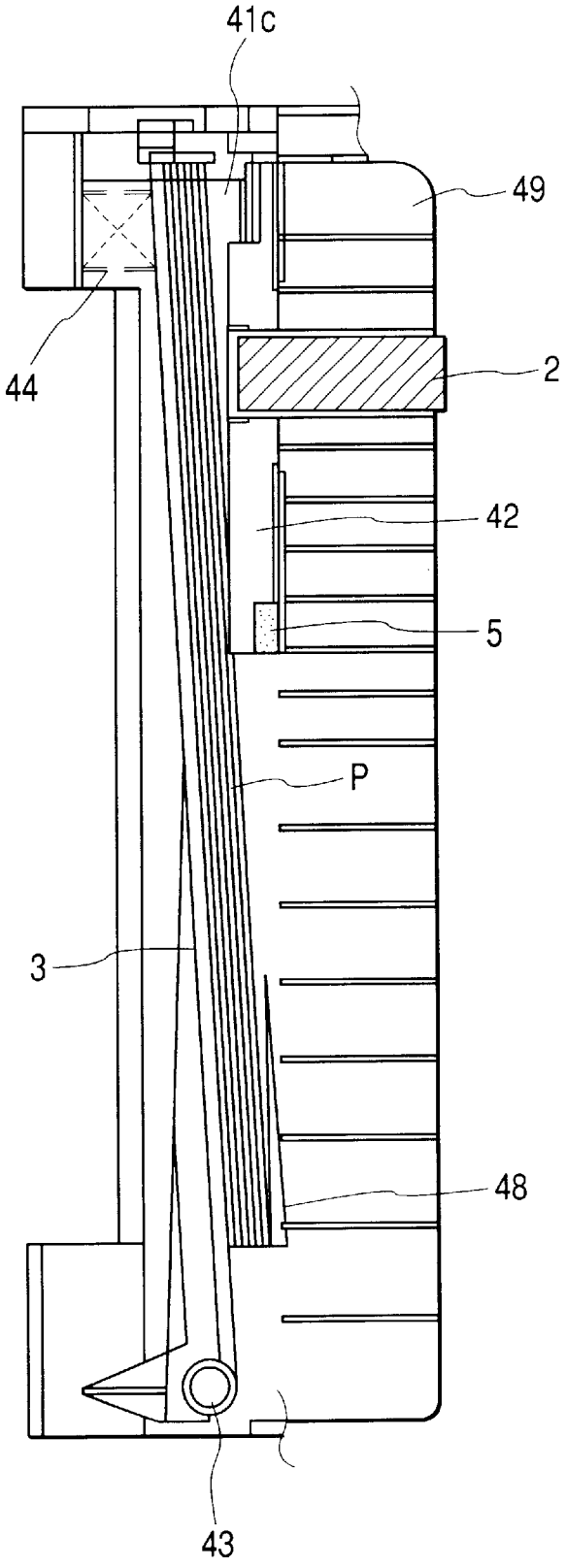
FIG. 13 is a drawing viewed from the arrow direction in FIG. 12, showing a state that the hopper is moved down.

Next, the operation of the hopper will be described with reference to FIGS. 12 to 14.

At a home position of the paper feeding roller 2, the paper returner 42 is retained at a stand-up position by a spring 47. While the paper feeding roller 2 arrives at the home position, the hopper 3 is rotated on the support point 43 by a hopper cam 34 against the urging force of a spring 44 and is maintained at the position shown in FIGS. 12 and 13 (moved-down state). If a plurality of sheets of paper P are set when the hopper is moved down, entry of the lower part of paper into a paper transporting passage is blocked by the paper returner 42 and the leading edges of paper sheets abut against the aligning face 41*c* of a frame 41 to be aligned. On the support point 43 side of the hopper 3, the aligning face 41*c* is not as thick as the thickness of a plurality of sheets of paper P and thus the paper overhangs from the aligning face 41*c* to the side of a paper guide 49, as shown in FIG. 12. When paper is set, a second paper retainer 48 regulates entry motion of the overhung part of the sheets into the paper transporting passage before the leading end of the sheet is fed by the paper feeding roller 2 (skew feeding), so that paper is set correctly.

Figure 14:
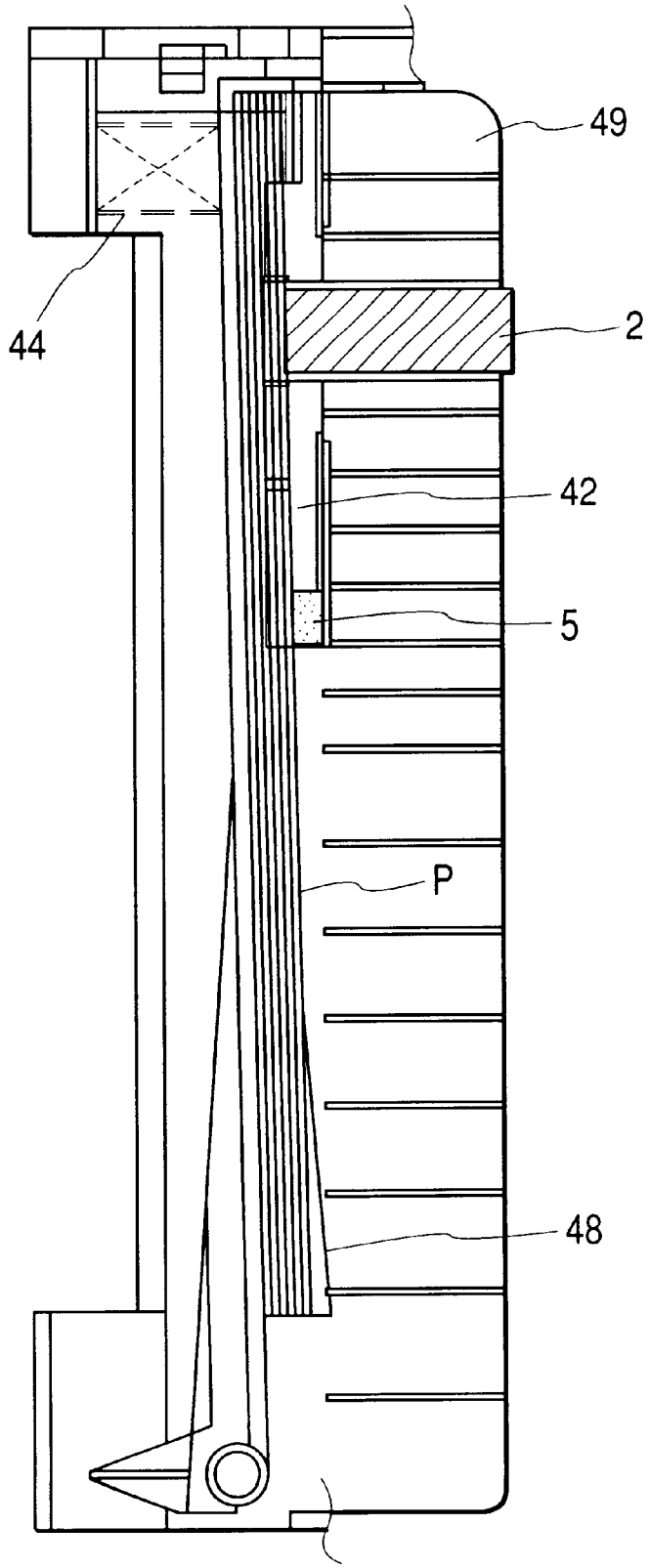
FIG. 14 is a drawing viewed from the arrow direction in FIG. 12, showing the hopper is moved up.

When paper feed starts, the hopper 3 moves up to the position shown in FIG. 14 and presses paper against the paper feeding roller 2. At this time, the number of overhung sheets of paper is increased in comparison with the moved-down state of the hopper 3, however, the first paper retainer 5 of the paper returner 42 retains the leading ends of the sheets for suppressing the skew feeding occurring on the support point side of the hopper 3.

When the top sheet of paper is fed, the leading end of sheet on the support point side also starts to enter by the paper feeding roller 2. At this time, the paper feeding roller side of the second paper retainer 48 is narrow, so that the leading end of sheet is not caught therein and can climb over smoothly. A preferred advantage can be provided particularly for firm paper such as OHP sheets. The paper returner 42 becomes flush with the paper guide 49 at the fall-down position of the paper returner 42 and the leading end of sheet at an almost intermediate point in the paper width direction is restrained by the first paper retainer 5, so that the skew feeding of the leading ends of sheets occurring on the support point side of the hopper 3 is suppressed. Accordingly, the paper enters the paper transporting passage straight.

Figure 15:
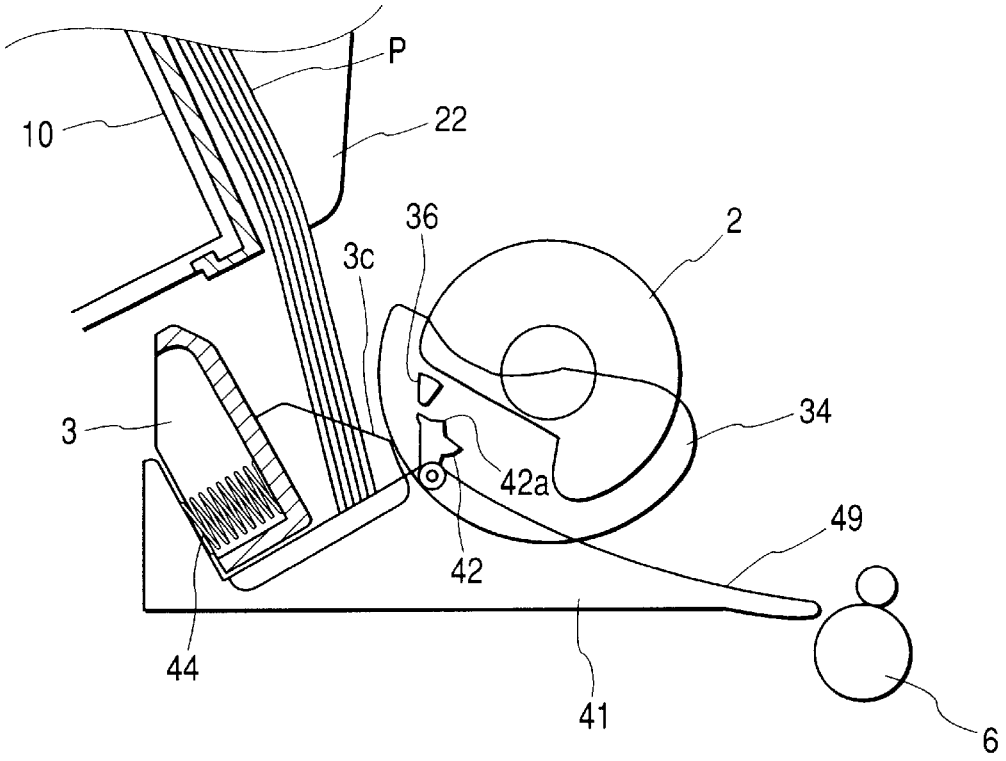
FIG. 15 is a drawing to show the relationship between the hopper and the paper returner when a paper feeding roller is at a home position.

Next, the paper feed operation will be explained in detail. FIGS. 15 to 27 are schematic representations to show a flow of the paper feed operation. A plurality of sheets of paper P are set in a paper support 21. A flat portion 2*c* of the paper feeding roller 2 at the home position is almost parallel to a face of the paper guide 49 of the frame 41. The paper returner 42 stands up and does not interfere with the paper feeding roller 2. In this state, it is blocked accidental entrance of the leading end of the set paper into the transport passage between, the paper feeding roller 2 and the hopper 3. On the other hand, the hopper 3 is pressed down to the lowermost position by a hopper driving cam 34 (state in FIG. 15).

Figure 16:
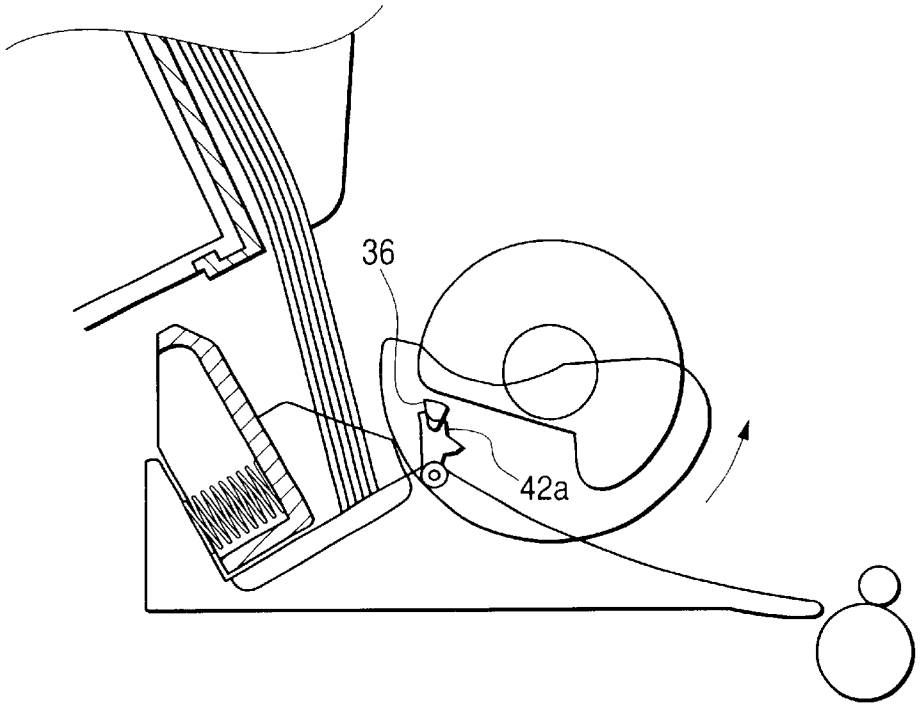
FIG. 16 is a drawing to show staring to fall down the paper returner by a subsidiary cam.
Figure 17:
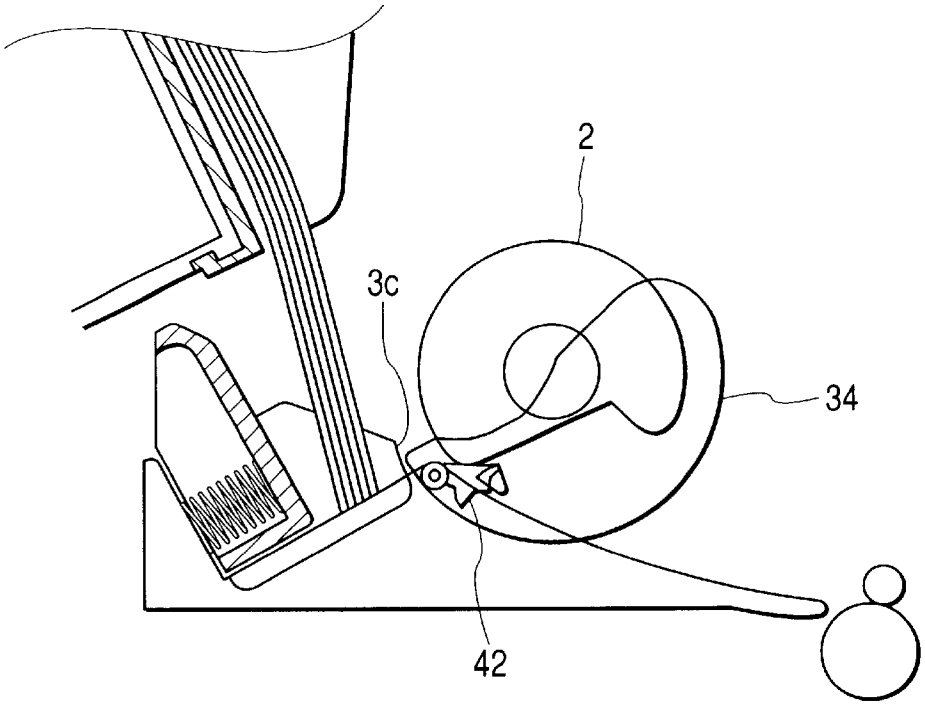
FIG. 17 is a drawing to show a state in which the paper feeding roller abuts a separation pad.
Figure 18:
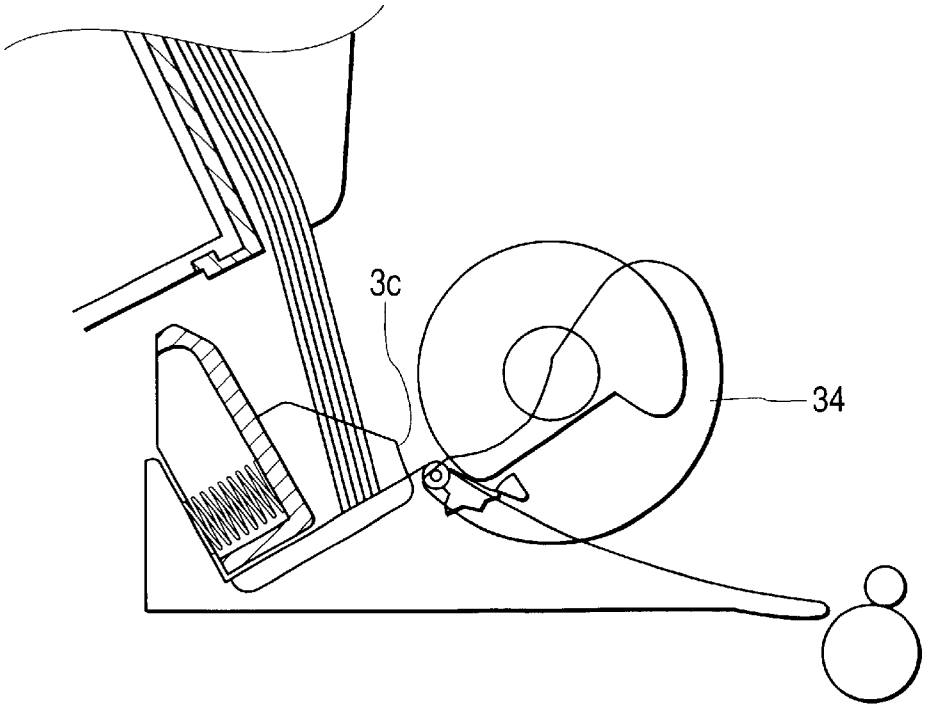
FIG. 18 is a drawing to show a fall-down position of the paper returner.

When the paper feeding roller 2 rotates as paper feed starts, the subsidiary cam 36 first acts on the cam follower 42*a* of the paper returner 42 so that the paper returner 42 is slightly inclined as the initial operation of falling down (state in FIG. 16).

After the paper returner 42 is inclined at a predetermined angle, the paper feeding roller 2 abuts the surface of the paper returner 42 and rotates the paper returner 42 toward the fall-down position by the rotation press force against the urging force of the paper returner spring 47. Meanwhile, the hopper driving cam 34 acts on the hopper cam follower 3*c* for maintaining the hopper 3 at the lowermost position (state in FIG. 17).

Figure 19:
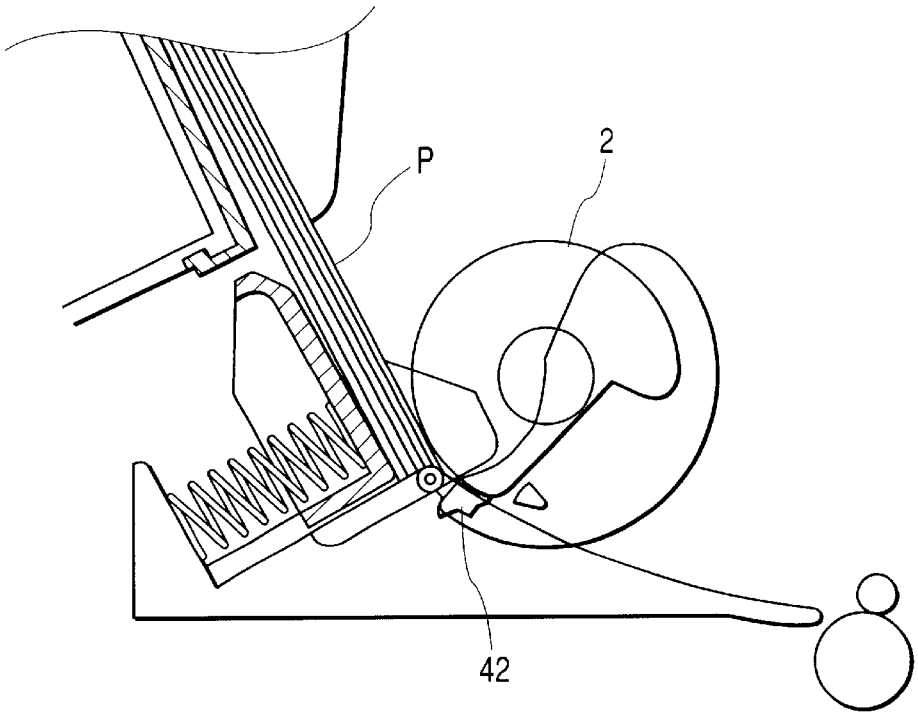
FIG. 19 is a drawing to show a state just after the hopper moves up.

The paper returner 42 reaches the fall-down position (state in FIG. 18) and then maintaining the hopper 3 at the lowermost position by the hopper driving cam 34 is released and the hopper 3 is moved up by the hopper spring 44 for pressing the top sheet of paper against the paper feeding roller 2 (state in FIG. 19).

Figure 20:
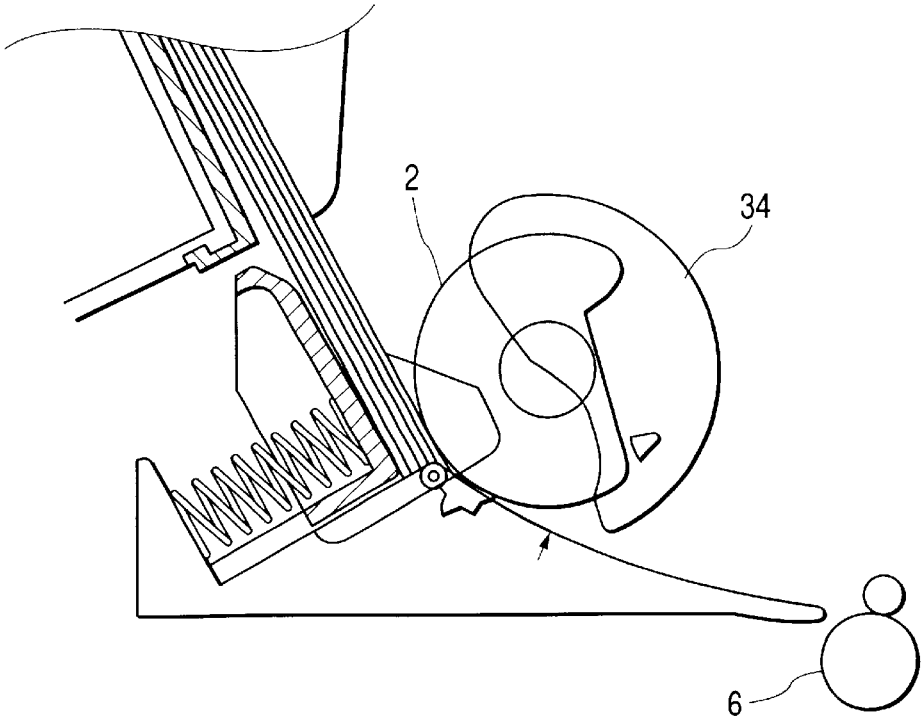
FIG. 20 is a drawing to show a state in which paper is being fed.

As the paper feeding roller 2 rotates, feeding the top sheet starts (state in FIG. 20). In the following figures, the upper arrow indicates the position of the leading end of the fed sheet.

Figure 21:
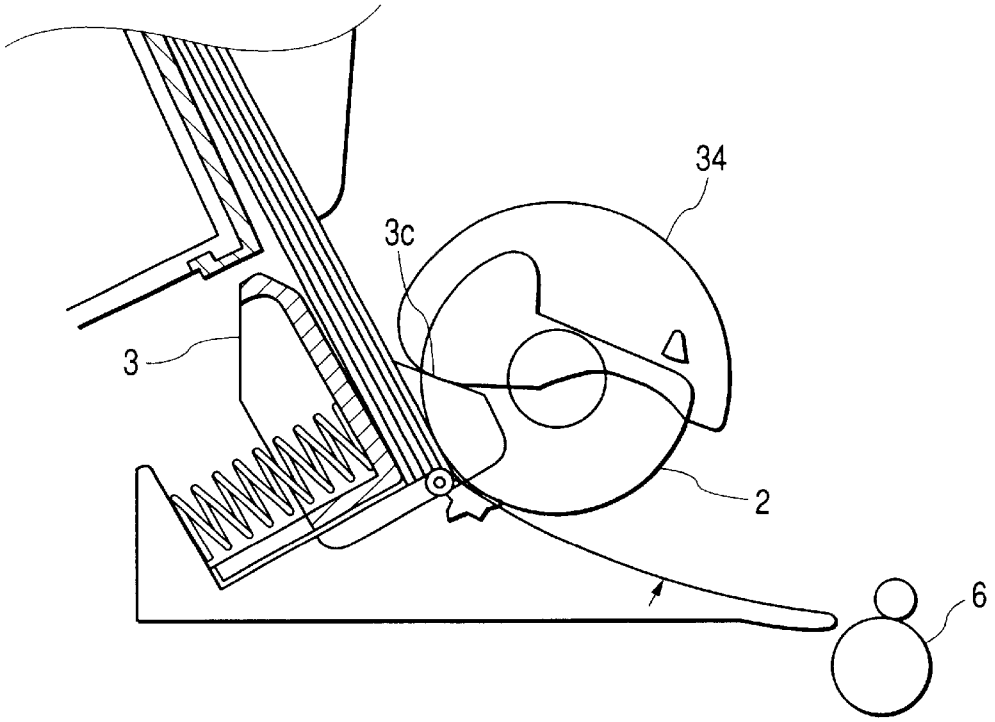
FIG. 21 is a drawing to show a state just before the hopper starts to move down.
Figure 22:
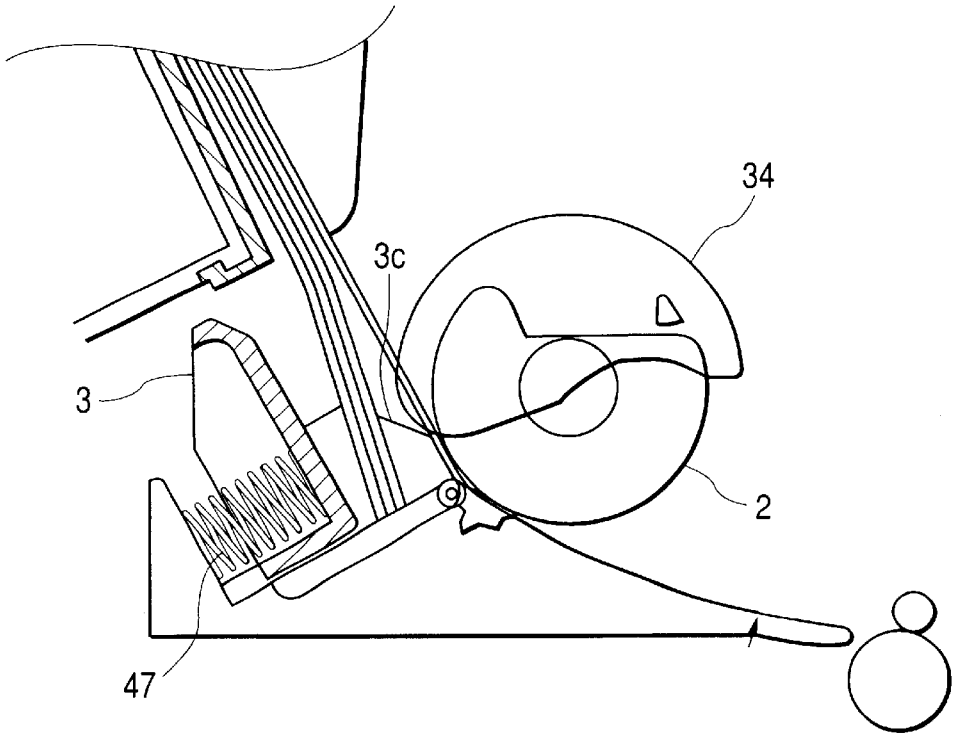
FIG. 22 is a drawing to show a state in which the hopper is moving down.
Figure 23:
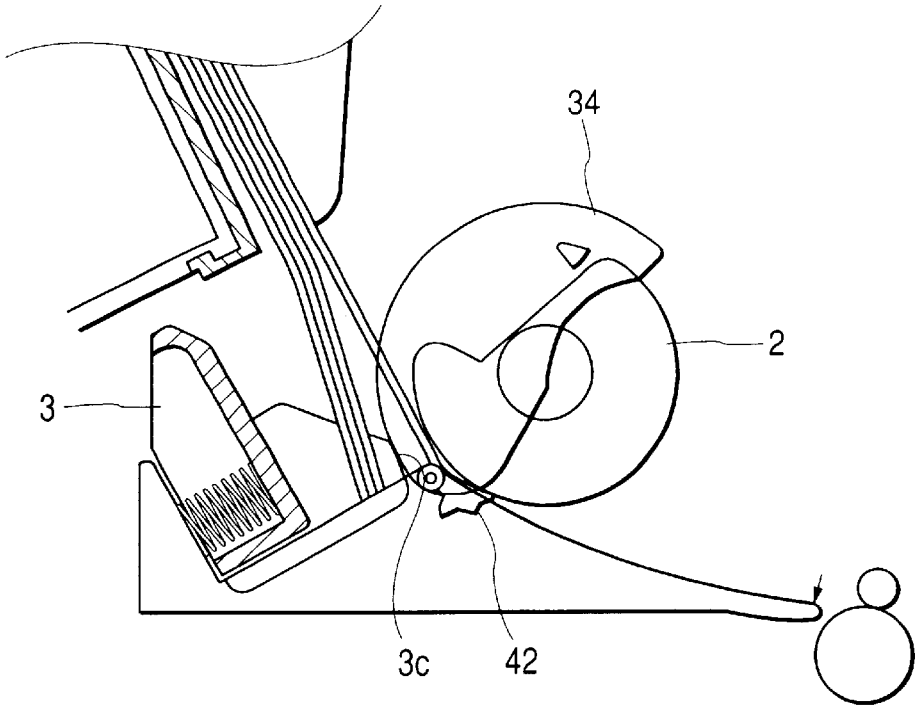
FIG. 23 is a drawing to show a state in which the hopper arrives at the lower limit.

Before the leading end of the fed sheet arrives at the transport roller 6, the hopper driving cam 34 acts on the cam follower 3c for starting to move down the hopper 3 at the position just before move down shown in FIG. 21. FIG. 22 shows a state in which the hopper 3 is moving down.

Figure 24:
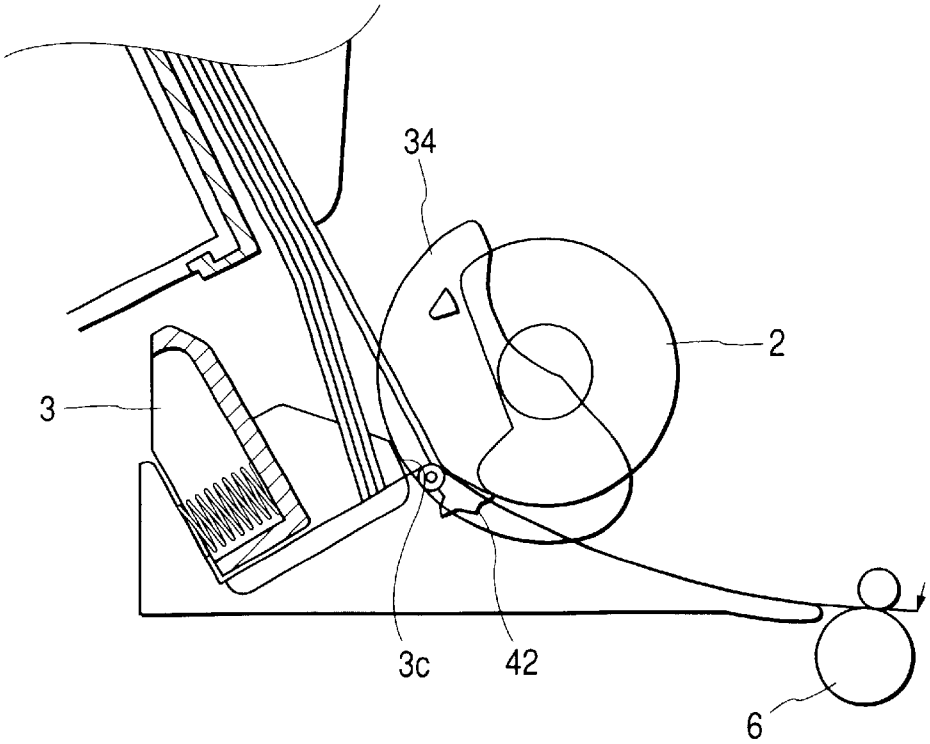
FIG. 24 is a drawing to show a state just before the paper returner starts the stand-up operation.

The hopper 3 arrives at the lowermost position (FIG. 23) and then the standing-up operation of the paper returner 42 is started by the spring force of the paper returner spring 47. FIG. 24 shows a state just before the paper returner 42 is stood up. Meanwhile, the leading end of the fed sheet arrives at the transport roller 6 so that the skew removal and the positioning operation are performed.

Figure 25:
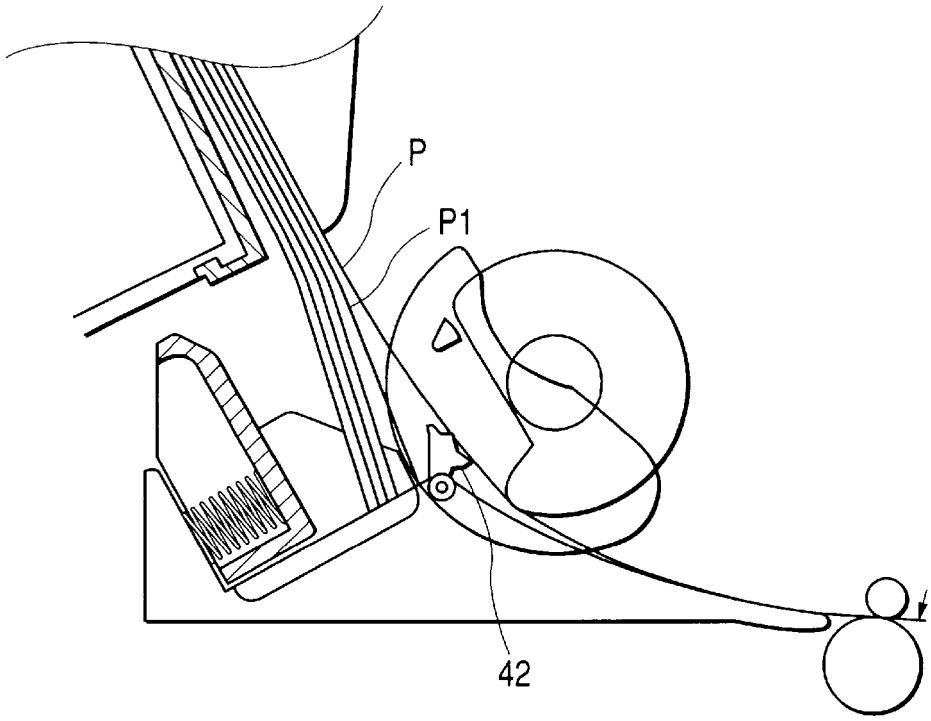
FIG. 25 is a drawing to show a state in which the paper returner arrives at a stand-up position and paper return is completed.
Figure 26:
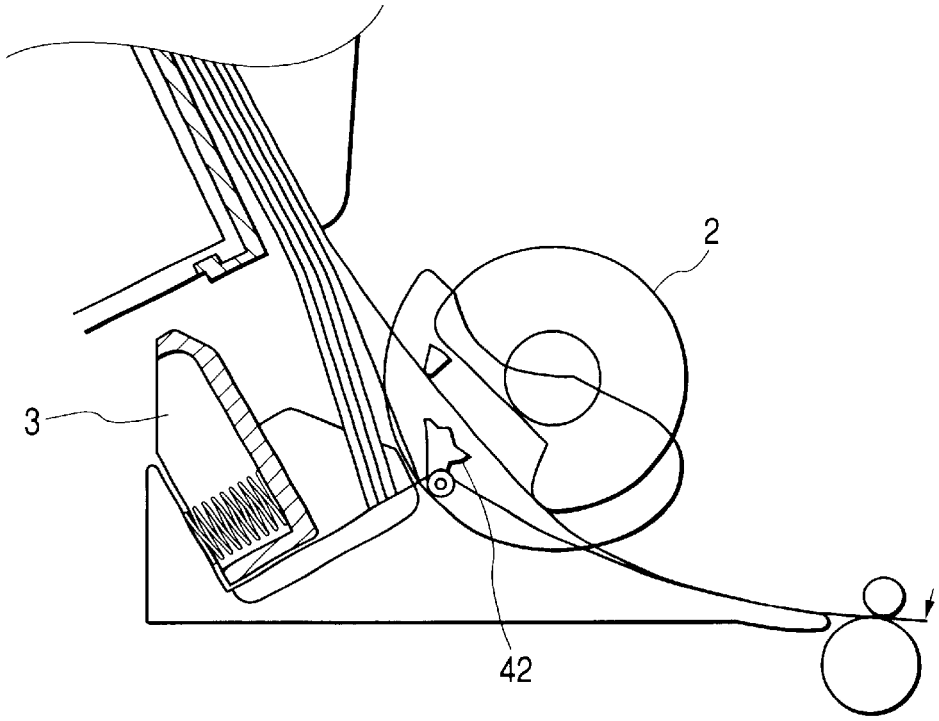
FIG. 26 is a drawing to show rotation of the paper feeding roller after the paper return is completed.
Figure 27:
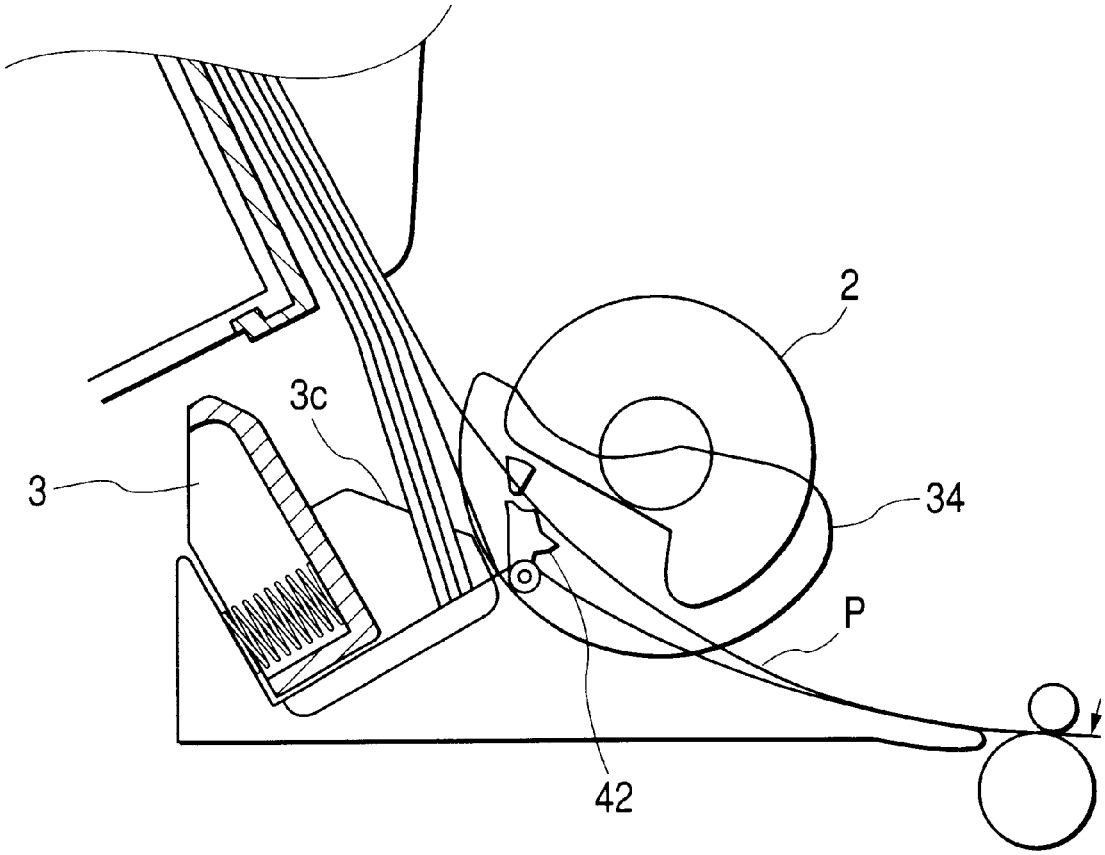
FIG. 27 is a drawing to show a state in which the paper feeding roller is returned to the home position.

Subsequently, standing up the paper returner 42 is completed by the spring force of the paper returner spring 47. During the rotating for standing up the paper returner 42, a leading end of a sheet P1 overlappedly transported with the top sheet P and entered between the paper feeding roller 2 and the paper returner 42 by a wedge effect in the previous operation is grasped, and the sheet P1 is pushed back into the hopper 3. FIG. 25 shows a state at the paper returning operation is completed. FIG. 26 shows a state in which the paper feeding roller 2 is rotating to the home position after completion of the paper returning operation. While the paper feeding roller 2 is returned to the home position, print on the paper P is started (state in FIG. 27).

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A paper feeder, for feeding a sheet of paper to a transporting path extending to a recording apparatus, comprising:

a paper feeding roller, provided in the vicinity of a first widthwise end of the transporting path;

a hopper, for stacking a plurality of sheets of paper, including:

an aligning face, on which leading ends of the stacked sheets are abutted to be aligned with each other, the aligning face being narrowed from a first side end thereof to a second side end thereof, the first side end being in the vicinity of the first widthwise end of the transporting path, and the second side end being in the vicinity of a second widthwise end of the transporting path;

a guide face, provided on the first side end of the aligning face so as to extend parallel with the transporting path; and a hopper member, pivotably supported on the second side end of the aligning face in a cantilevered manner, so as to move on the aligning face such that distance change in accordance with the number of sheets stacked thereon in the first widthwise end side of the transporting path with respect to the paper feeding roller becomes larger than that in the second widthwise end side of the: transporting path;

a paper returner, placed in the vicinity of an end portion of the hopper which faces the paper feeding roller, so as to be pivotable between a first position where the paper returner constitutes a part of the paper transporting passage, and a second position where the paper returner is isolated from the paper transporting passage; and a first paper retainer, provided on the first surface of the paper returner in the vicinity of the guide face of the hopper, wherein the paper returner is placed at the first position so that a top sheet of paper in the hopper is abutted against the paper feeding roller, and is separated from other sheets of paper by a separation pad; and wherein the paper returner is placed at the second position so that a first face of the paper returner returns sheets of paper, which are entered in the paper transporting passage together with the sheet of paper to be fed, to the hopper.

2. The paper feeder as set forth in claim 1, further comprising the separation pad, provided on the first face of the paper returner, the separation pad having a friction coefficient which is higher than a friction coefficient of the first face of the paper returner.

3. The paper feeder as set forth in claim 1, further comprising an urging member r, which urges the paper returner toward the second position, wherein the paper feeding roller includes a first portion which urges the first face of the paper returner toward the first position, against an urging force of the urging member.

4. The paper feeder as set forth in claim 1, wherein the first paper retainer is a sheet member having a higher friction coefficient than t he first face of the paper returner.

5. The paper feeder as set forth in claim 1, further comprising a second paper retainer, provided in the vicinity of the pivotal center of the hopper member, the second retainer having a support face for supporting a part of sheets stacked on the hopper member.

6. The paper feeder as set forth in claim 5, wherein the support face of the second paper retainer is narrowed from a side closer to the pivotal center of the hopper member to a side closer to the paper feeding roller.

7. The paper feeder as set forth in claim 5, wherein the support face of the second paper retainer is placed such that a leading end of the sheet in the vicinity of the pivotal center of the hopper member is abutted thereon when the paper retainer is placed at the first position.

8. A paper feeder, for feeding a sheet of paper to a transporting path extending to a recording apparatus, comprising:

a paper feeding roller, provided in the vicinity of a first widthwise end of the transporting path;

a hopper, for stacking a plurality of sheets of paper, including:

an aligning face, on which leading ends of the stacked sheets are abutted to be aligned with each other, the aligning face being narrowed from a first side end thereof to a second side end thereof, the first side end being in the vicinity of the first widthwise end of the transporting path, and the second side end being in the vicinity of a second widthwise end of the transporting path;

a guide face, provided on the first side end of the aligning face so as to extend parallel with the transporting path; and a hopper member, pivotably supported on the second side end of the aligning face in a cantilevered manner, so as to move on the aligning face such that distance change in accordance with the number of sheets stacked thereon in the first widthwise end side of the transporting path with respect to the paper feeding roller becomes larger than that in the second widthwise end side of the transporting path;

a paper returner, placed in the vicinity of an end portion of the hopper which faces the paper feeding roller, so as to be pivotable between a first position where the paper returner constitutes a part of the paper transporting passage, and a second position where the paper returner is isolated from the paper transporting passage; and a first paper retainer, provided in the vicinity of the pivotal center of the hopper member, a second retainer having a support face for supporting a part of sheets stacked on the hopper member;

wherein the paper returner is placed at the first position so that a top sheet of paper in the hopper is abutted against the paper feeding roller, and is separated from other sheets of paper by a separation pad; and wherein the paper returner is placed at the second position so that a first face of the paper returner returns sheets of paper, which are entered in the paper transporting passage together with the sheet of paper to be fed, to the hopper.

9. The paper feeder as set forth in claim 8, further comprising the separation pad, provided on the first face of the paper returner, the separation pad having a friction coefficient which is higher than a friction coefficient of the first face of the paper returner.

10. The paper feeder as set forth in claim 8, further comprising an urging member, which urges the paper returner toward the second position, wherein the paper feeding roller includes a first portion which urges the first face of the paper returner toward the first position, against an urging force of the urging member.

11. The paper feeder as set forth in claim 8, wherein the support face of the second paper retainer is narrowed from a side closer to the pivotal center of the hopper member to a side closer to the paper feeding roller.

12. The paper feeder as set forth in claim 8, wherein the support face of the first paper retainer is placed such that a leading end of the sheet in the vicinity of the pivotal center of the hopper member i s a butted thereon when the paper retainer is placed at the first position.

13. The paper feeder as set forth in claim 8, further comprising a second paper retainer, provided on the first surface of the paper returner in the vicinity of the guide face of the hopper.

14. The paper feeder as set forth in claim 13, wherein the second paper retainer is a sheet member having a higher friction coefficient than the first face of the paper returner.

* * * * *